US005898405A

United States Patent [19]

Iwasaki

[11] Patent Number: 5,898,405

[45] Date of Patent: Apr. 27, 1999

[54] OMNIDIRECTIONAL ANTENNA FORMED ONE OR TWO ANTENNA ELEMENTS SYMMETRICALLY TO A GROUND CONDUCTOR

[75] Inventor: Hisao Iwasaki, Tama, Japan

[73] Assignee: Kabushiki Kaisha Toshiba, Kawasaki, Japan

[21] Appl. No.: 08/819,987

[22] Filed: Mar. 18, 1997

Related U.S. Application Data

[63] Continuation of application No. 08/587,797, Dec. 26, 1995, abandoned.

[30] Foreign Application Priority Data

Dec. 27, 1994 [JP] Japan ..... 6-325565

[51] Int. Cl.[6] ..... H01Q 1/38

[52] U.S. Cl. ..... 343/700 MS; 343/872; 343/846

[58] Field of Search ..... 343/700 MS, 872, 343/846, 848, 873, 829; H01Q 1/38

[56] References Cited

U.S. PATENT DOCUMENTS

| | | | |
|---|---|---|---|
| 4,072,952 | 2/1978 | Demko | 343/700 MS |
| 4,197,544 | 4/1980 | Kaloi | 343/700 MS |
| 4,527,163 | 7/1985 | Stanton | 343/700 MS |
| 4,816,836 | 3/1989 | Lalezari | 343/700 MS |
| 4,899,164 | 2/1990 | McGrath | 343/700 MS |
| 4,922,259 | 5/1990 | Hall et al. | 343/700 MS |
| 4,980,692 | 12/1990 | Rudish et al. | 343/700 MS |

FOREIGN PATENT DOCUMENTS 6-66578 8/1994 Japan .

*Primary Examiner*—Hoanganh Le

*Attorney, Agent, or Firm*—Finnegan, Henderson, Farabow, Garrett & Dunner, L.L.P.

[57] ABSTRACT

On respective ground conductor plate surfaces, first and second dielectric substrates are formed. First and second antenna elements made of a conductor film of a rectangular cooper leaf or the like are formed on opposite surfaces of the first and second dielectric substrates to the ground conductor plate. The first and second antenna elements-are fed by, for example, a coplanar waveguide feed line, slot feed or the like. Thus, an omnidirectional antenna is realized having simple construction, reducing a size and production cost.

15 Claims, 17 Drawing Sheets

OMNIDIRECTIONAL ANTENNA FORMED ONE OR TWO ANTENNA ELEMENTS SYMMETRICALLY TO A GROUND CONDUCTOR

This application is a continuation, of application Ser. No. 08/587,797, filed Dec. 26. 1995, now abandoned.

BACKGROUND OF THE INVENTION

1. Field of the Invention

This invention relates to an omnidirectional antenna having almost uniform radiation directivity to a horizontal surface for use with communication systems such as mobile communication, indoor radio, or LAN (Local Area Network).

2. Description of the Related Art

An antenna used for with a radio base station for a mobile communication in the underground shopping center or an indoor base station for mobile radio should be small, thin and be produced at a low cost. In addition, the antenna is required to have such radiation directivity as omnidirectional to the horizontal surface, and as beam-tilted downward to the vertical surface, because it is installed in the underground shopping center or on the indoor ceiling portion.

Conventionally, in the radio base station for mobile communication, in particular, in the base station of a car telephone, a Collinia array antenna arranged multistage dipole elements in the longitudinal direction to realize a beam-tilt directivity. However, it is difficult to use a large-sized array antenna indoors.

As an antenna to satisfy such requirement, "Beam-tilt Dipole Antenna for Indoor Base Station" reported in the great autumn meeting SB-1-8, IEICE of Japan, 1994 is known. This beam-tilt dipole antenna is arranged a plurality of passive elements tilted at a predetermined angle in a form of spatially independent around exciting elements. However, the beam-tilt dipole antenna has a problem of complex structure. In addition, antenna elements are composed of linear elements. Although unit cost of elements is lower, installation requires much labor, thereby raising the production cost. Moreover, when forming an array antenna with the beam-tilt dipole antenna, not only a construction becomes more complicated, but also novel is needed to feed by a coaxial feed line to a number of elements. Thereby, production is difficult and a production cost is raised, as well as an excessive radiation is occurred from a feed line, deteriorating an antenna gain.

Further, in Japanese Patent Published application Ser. No. HEI 6-66578, "omnidirectional microstrip antenna" is disclosed that cylinder passive elements are fed by microstrip feed lines. The antenna alone realizes omnidirection in a horizontal surface, and is compactly constructed easily. When forming an array antenna with the antenna, cylinder passive elements are disposed along with longer sides at predetermined intervals. These elements are fed parallel by the microstrip feed lines. However, in this construction, a plurality of microstrip lines are disposed within a cylinder which forms passive elements to feed a plurality of passive elements. Thereby, not only the construction becomes complicated, but also a radius of the column should be large. Thus, an advantage of reducing a size is lost. Further, in the microstrip feed lines, inner portions of the cylinder passive elements work as antenna elements. Connecting portions of these antenna elements produce an excessive radiation, thereby deteriorating an antenna gain.

SUMMARY OF THE INVENTION

As described above, in a conventional omnidirectional antenna, the structure becomes complicated, in particular in an array antenna, it is difficult to reduce a size, and an antenna gain is deteriorated by an excessive radiation from feed lines.

A first object of the present invention is to provide an omnidirectional antenna which has a simple structure, reduces a size, and is produced at a low cost.

A second object of the present invention is to provide an omnidirectional antenna which has a simple structure, reduces a size, and is produced at a low cost, when forming an array antenna with the antenna.

A third object of the present invention is to provide an omnidirectional antenna-which has no excessive radiation from a feed line and obtains an excellent antenna gain.

A fourth object of the present invention is to provide an omnidirectional antenna which has a simple structure with a small number of parts, reduces a size, and enhances an environmental resistance.

To accomplish these objects, an antenna according to the present invention comprises a ground conductor plate, a first antenna element opposed to a first surface of said ground conductor plate, a second antenna element opposed to a second surface of said ground conductor plate, a first dielectric substrate formed between said ground conductor plate and said first antenna element, a second dielectric substrate formed between said ground conductor plate and said second antenna element, and a feed means for feeding said first antenna element and said second antenna element.

As said feed means, for example, a coplanar feed line, a direct feed line, a slot feed or the like is existed. Further, dimensions of said first dielectric substrate and said second dielectric substrate intersected with longer sides of feed lines of said feed means at right angle are set to 0.1 to 0.35 times of wave length used, thereby omnidirectional is realized.

According to the present invention, a plurality of said first antenna elements and a plurality of said second antenna elements are disposed along with longer sides of feed lines of said feed means at predetermined intervals, respectively. Thereby, an array antenna is realized. In the array antenna, a phase difference is set to a predetermined electric length of lines connected between said first antenna elements and between second antenna elements, thereby radiation directivity is realized that has omnidirectional to a horizontal surface, and is beam-tilted downward to a vertical surface.

In this case, antenna elements are formed on dielectric substrates as patch antennas using a photolithography technology or the like. Therefore, a unit cost of elements is low, as well as a plurality of antenna elements are arranged on common first and second dielectric substrates to realize an array antenna. Thus, a small array antenna is obtained with a simple production method at a lower cost.

In addition, when a feed means such as coplanar feed line or a slot feed line is used, feed lines are formed within the ground conductor plate between first and second dielectric substrates. Therefore, no excessive radiation is occurred from the feed lines to the outside of the antenna. Consequently, it shows an excellent antenna gain.

Further an antenna according to the present invention comprises a pillar shape of a ground conductor, a cylindrical dielectric substrate surrounding said ground conductor, cylindrical antenna elements formed on a surface of said dielectric substrate opposed to said ground conductor, a feed means for feeding said antenna elements.

As a feed means of this case, for example, a coplanar feed line, a direct feed line, a slot feed line, or the like is existed. Array antenna and beam-tilt are also available.

In this case, cylindrical antenna elements are also formed on a dielectric substrate as a patch antenna using a photolithography technology or the like. Therefore, a unit cost of elements is low, as well as a plurality of antenna elements are arranged on a common dielectric substrate to realize an array antenna. Thus, a small array antenna is obtained with a simple production method at a lower cost. In addition, microstrip feed lines are formed within the cylindrical dielectric substrate. Therefore, no excessive radiation is occurred from the feed lines to the outside of the antenna. Consequently, it shows an excellent antenna gain. Moreover, all conductor portions of the antenna elements and the feed lines are formed within the cylindrical dielectric substrate, which is used as a radome. Thus, an environmental resistance is enhanced without installing a radome separately.

BRIEF DESCRIPTION OF THE DRAWINGS

In the accompanying drawings, there are shown illustrative embodiments of the invention from which these and other of its objective, novel features, and advantages will be readily apparent.

In the drawings.

DESCRIPTION OF THE PREFERRED EMBODIMENTS

Figure 1:
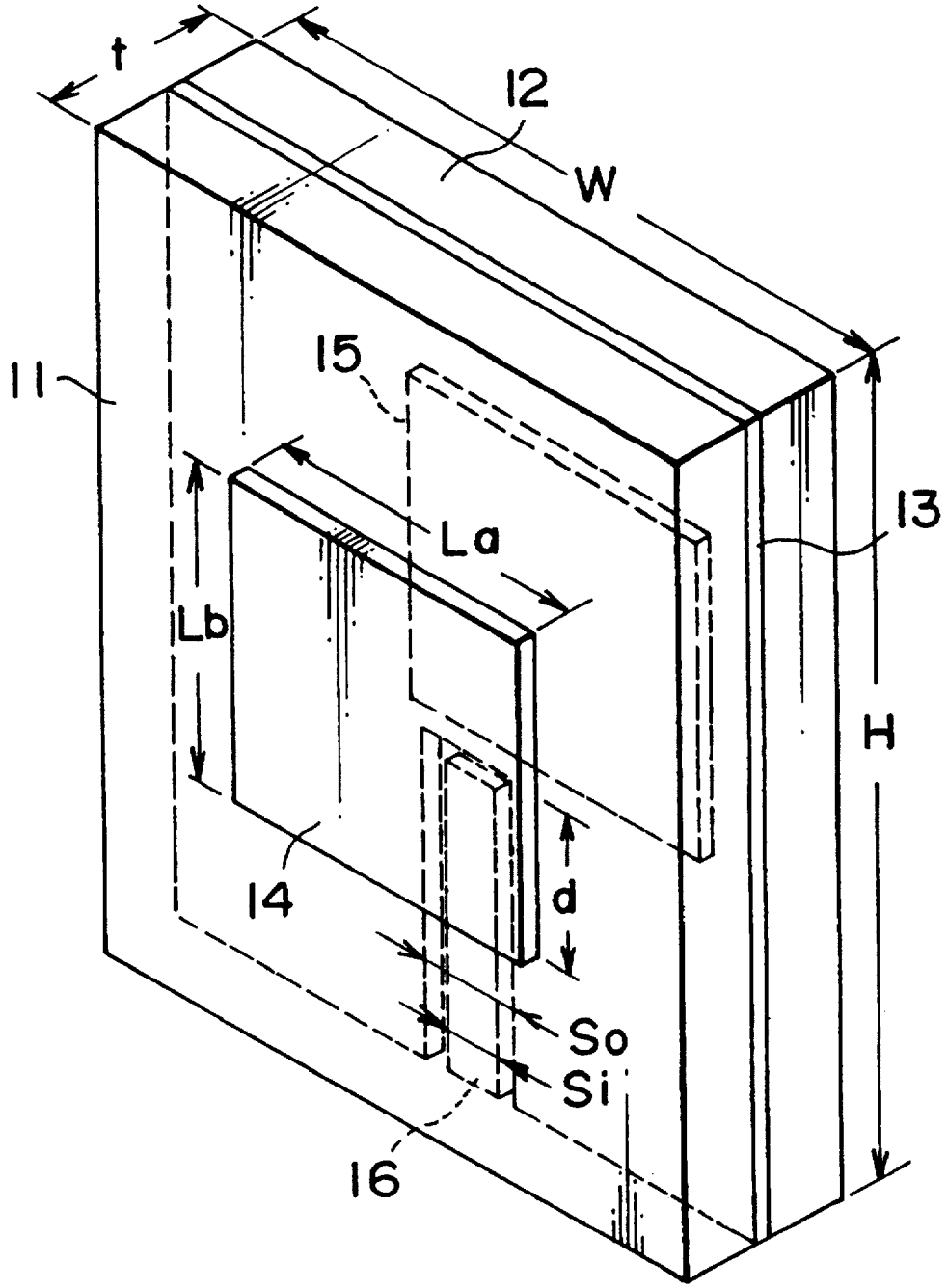
FIG. 1 is a perspective view showing an omnidirectional antenna accordance with an embodiment of the present invention.
Figure 2:
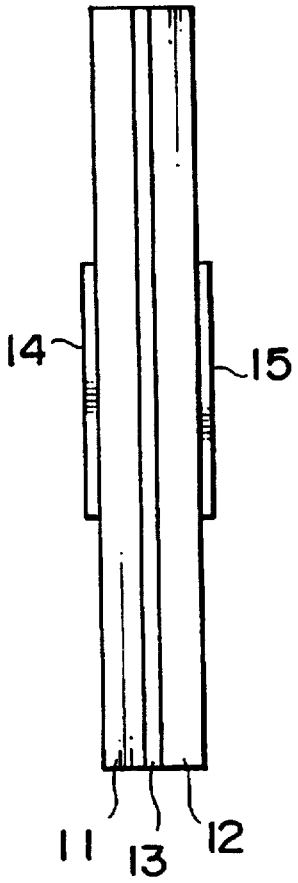
FIG. 2 is a side view of the omnidirectional antenna shown in FIG. 1.
Figure 3:
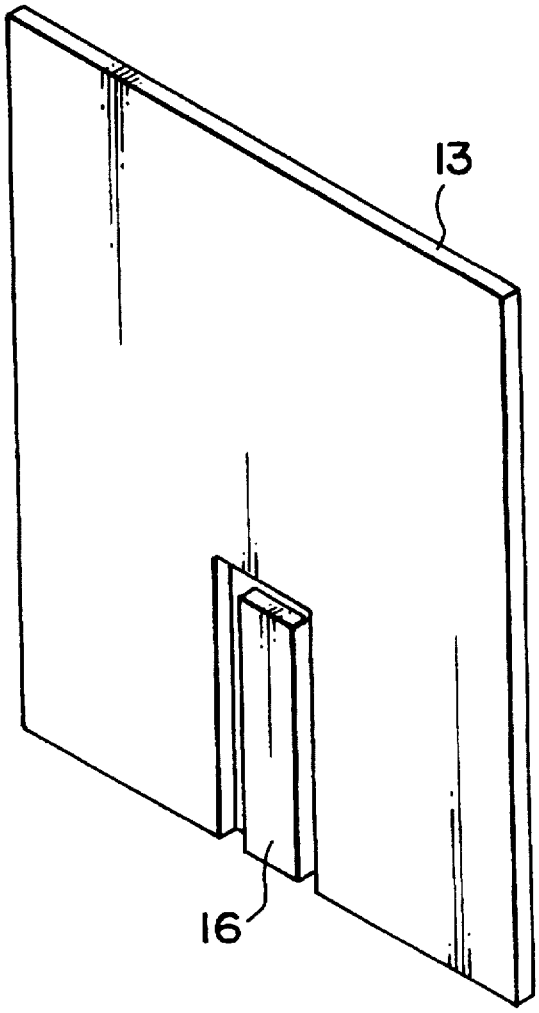
FIG. 3 is a perspective view of a ground conductor extracting from the omnidirectional antenna shown in FIG. 1.

FIG. 1 is a perspective view of an omnidirectional antenna accordance with an embodiment of the present invention. FIG. 2 is a side view of the omnidirectional antenna shown in FIG. 1. FIG. 3 is a perspective view of a ground conductor extracting from the omnidirectional antenna shown in FIG. 1.

In these figures, numeral 13 is a ground conductor plate. The ground conductor plate 13 is made of, for example, a copper plate. First and second dielectric substrates 11, 12 are formed on both surfaces of the ground conductor plate 13. First and second antenna elements 14, 15 made of a conductor film of a rectangular cooper leaf or the like are formed on the first and second dielectric substrates 11, 12. These antenna elements 14, 15 configure so-called patch antennas.

A coplanar waveguide feed line (CPW feed line) 16 is formed in line with the ground conductor 13. The CPW feed line 16 is in a narrow piece made by removing a bottom part of the ground conductor 13 with etching in a U-shape. Input/output terminal (not shown) is connected to the bottom of the CPW feed line 16.

The omnidirectional antenna is produced as follows: For example, the first dielectric substrate 11 is formed on a first surface of the ground conductor 13. The CPW feed line 16 formed by removing with etching. Then, the second dielectric substrate 12 is formed on a second surface of the ground conductor 13. Consequently, the first and second antenna elements 14, 15 are formed on the surfaces of the first and second dielectric substrate 11, 12 by a photolithography technology.

The operation of the omnidirectional antenna will be described. The antenna is installed so that the upper portion is in an upper position, for example, on the ceiling. When feeding through the input/output terminal connected to the bottom of the CPW feed line 16, the antenna elements 14, 15 contacted to the CPW feed line 16 emit radio waves to the opposite directions of respective vertical surfaces.

The widths of the dielectric substrates 11, 12 (dimensions intersected with a longer side of the CPW feed line 16 at right angle) are W; the lengths of the dielectric substrates 11, 12 (dimensions along with the longer side of the CPW feed line 16) are H; the specific inductive capacity is er; the thickness of the layer-built dielectric substrates 11, 12 and the ground conductor plate 13 is t; the widths of the antenna elements 14, 15 are La; and the length of the antenna elements 14, 15 are Lb. The width of the CPW feed 16 line is Si; the distance of the edge portion of the ground conductor 13 for the feed line 16 is So; and the length of the overlapped portion of the CPW feed line 16 and the antenna elements 14, 15 is d. As a trial, an antenna is produced set above-mentioned parameters so that the resonance frequency is 1.8975 GHz. The parameters are: H=150 mm, La=Lb=47.36 mm, t=3.2 mm, $\epsilon r$=2.6, Si=4.5 mm, So=4.9 mm, d=23.68 mm.

The wave length of the trial antenna is $\lambda$ in 1.8975 GHz of the frequency. Table 1 shows a 3 dB beam width of H plane directivity when the widths W of the dielectric substrates 11, 12 are varied from 0.19$\lambda$ to 0.95$\lambda$, and a level difference (maximum value minus minimum value) of the radiation directivity in the front direction (y axis direction) of respective antenna elements 14, 15 and in the direction 90° turned to the front direction (x axis direction) of respective antenna elements 14, 15. The 3 dB beam width is an angle of the H plane which the radiation directivity level is 3 dB less than the maximum value.

This measurement reveals that about 3 dB of level difference is realized to the surface intersected with the surface of the antenna elements 14, 15 at right angle (z axis direction), when the widths W of the dielectric substrates 11, 12 are in the range of 0.1$\lambda$ to 0.35$\lambda$. In other words, omnidirection is realized to the horizontal surface.

TABLE 1

| Width of the dielectric substrate W | 3 dB beam width | Difference between the maximum value and the minimum value (dB) |
|---|---|---|
| 150 mm (0.95 $\lambda$) | 74° | 9.4–11.8 |
| 130 mm (0.82 $\lambda$) | 78° | 10.9–11.7 |
| 110 mm (0.69 $\lambda$) | 79° | 8.5–9.8 |
| 90 mm (0.57 $\lambda$) | 86° | 6.0–6.6 |
| 70 mm (0.44 $\lambda$) | 92° | 6.1–6.3 |
| 60 mm (0.38 $\lambda$) | — | 3.1–4.3 |
| 50 mm (0.32 $\lambda$) | — | 2.4–3.5 |
| 30 mm (0.19 $\lambda$) | — | 3.2–3.5 |

Figure 4:
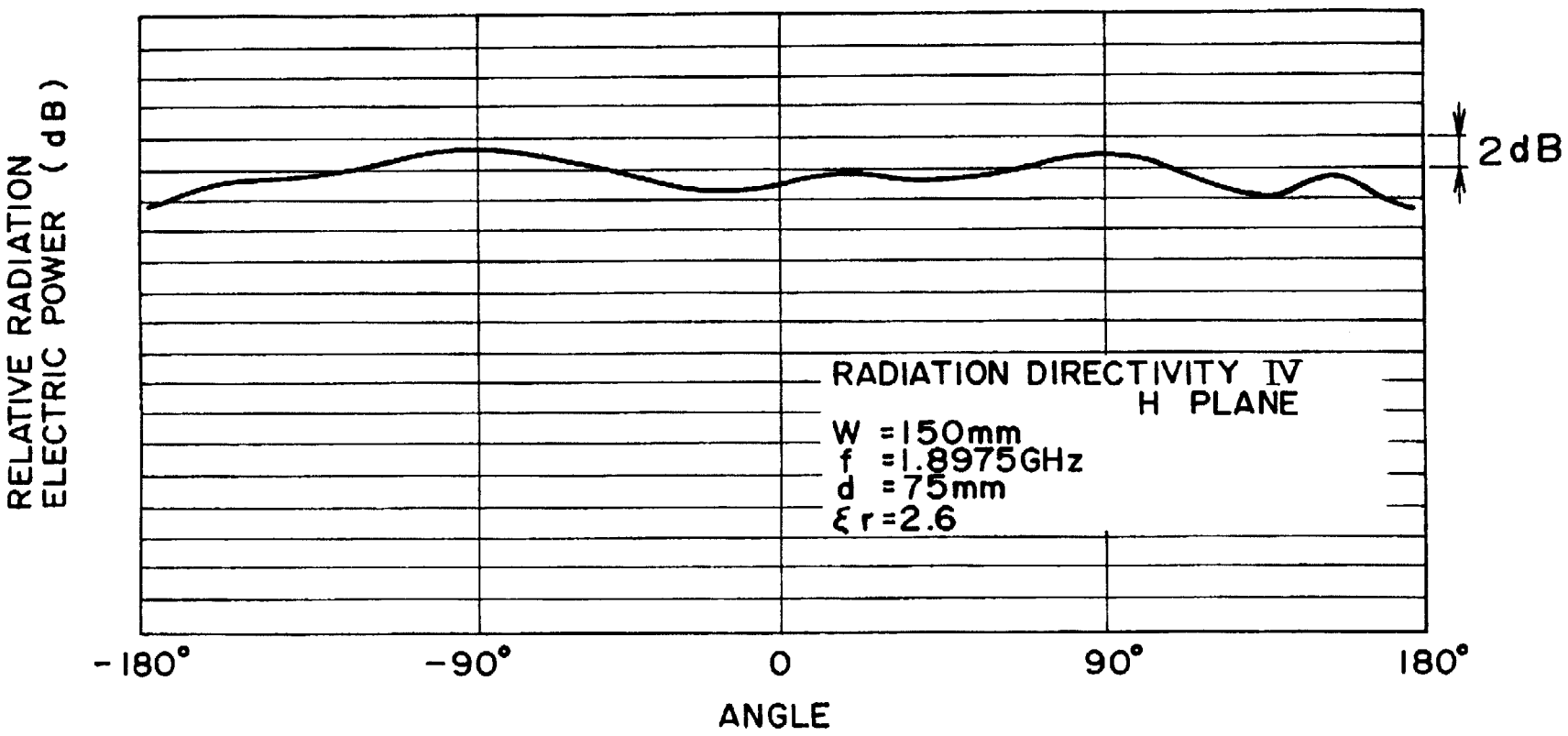
FIG. 4 shows a radiation directivity of the antenna according to the present trial.
Figure 5A:
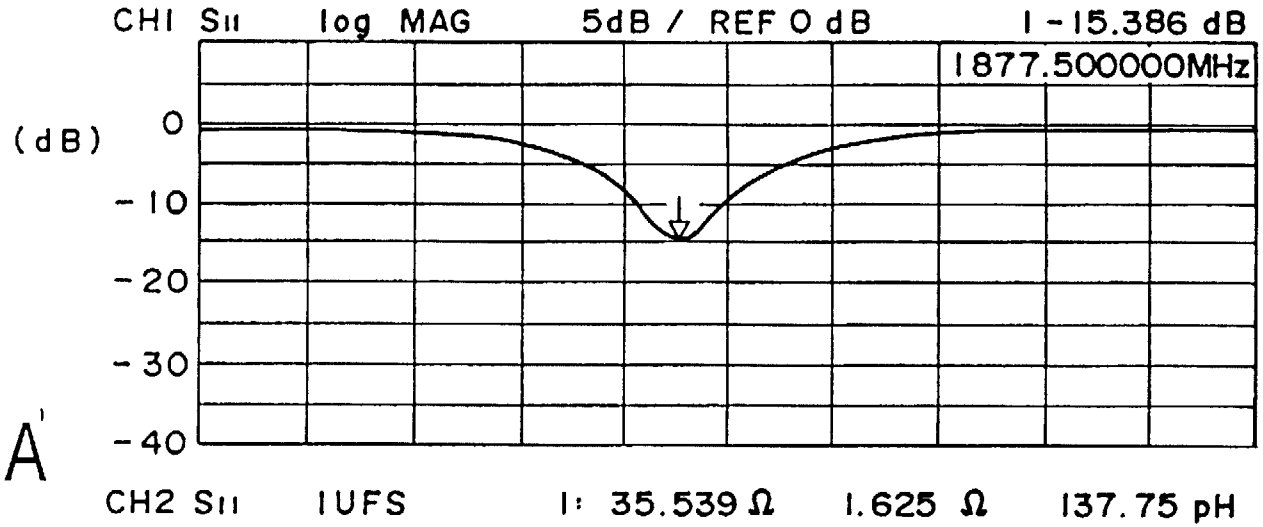
FIG. 5 shows an input impedance of the antenna according to the present trial.
Figure 5B:
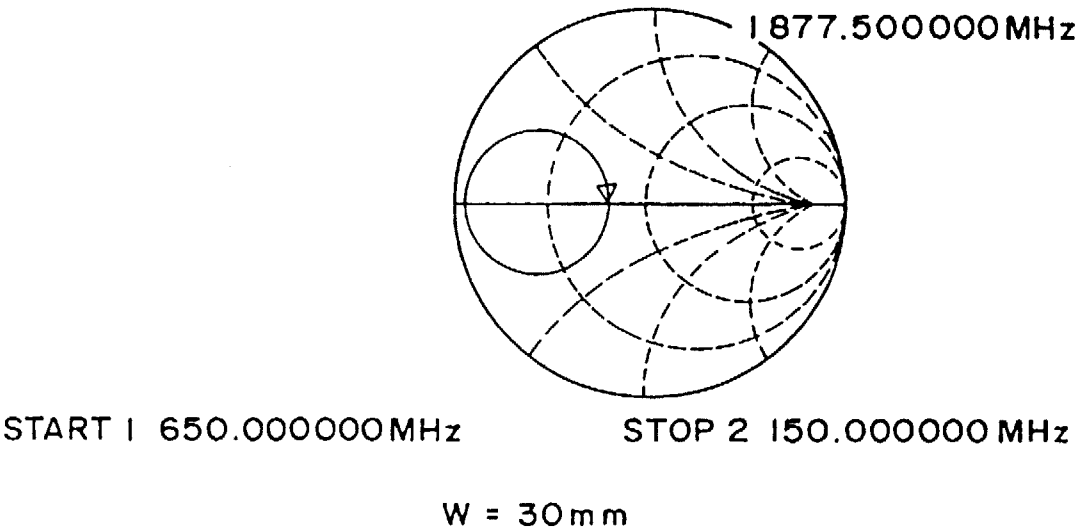

FIG. 4 shows a radiation directivity of the present trial antenna in the width W=50 mm. FIG. 5 shows an input impedance in the width W=30 mm. The band width where VSWR is not more than 2 is about 1.7%. This value is same as a normal patch antenna. Consequently, the present trial antenna works normally.

As a result, according to the embodiment, the antenna elements 14, 15 are matched with the CPW feed line 16, and the omnidirectional antenna is realized that has almost uniform radiation directivity to the surface intersected with the surface of the antenna elements 14, 15 at right angle.

The present trial antenna is in very small shape of about 60 mm or less of width W and 3.2 mm of thickness. The trial antenna has 2.6 of $\epsilon r$. The present invention is not limited to this size. The larger the $\epsilon r$ is, the thinner the width W is. Therefore, the antenna is smaller and lighter as well as simpler than the conventional omnidirectional antenna configured a plurality of linear elements in a circle arrangement. Thus, the antenna of the present invention is easily installed on the ceiling. Moreover, the antenna is basically a patch antenna in view of a configuration, and is easily produced by the photolithography technology. Thus, the production cost is reduced. The CPW feed line 16 is formed in the ground conductor plate 13 between the dielectric substrates 11 and 12. Therefore, no excessive radiation is occurred from the CPW feed line 16 to the outside of the antenna. Consequently, it shows an excellent antenna gain.

Then, an embodiment of an array antenna using a plurality of antennas shown in FIG. 1 to FIG. 3.

Figure 6:
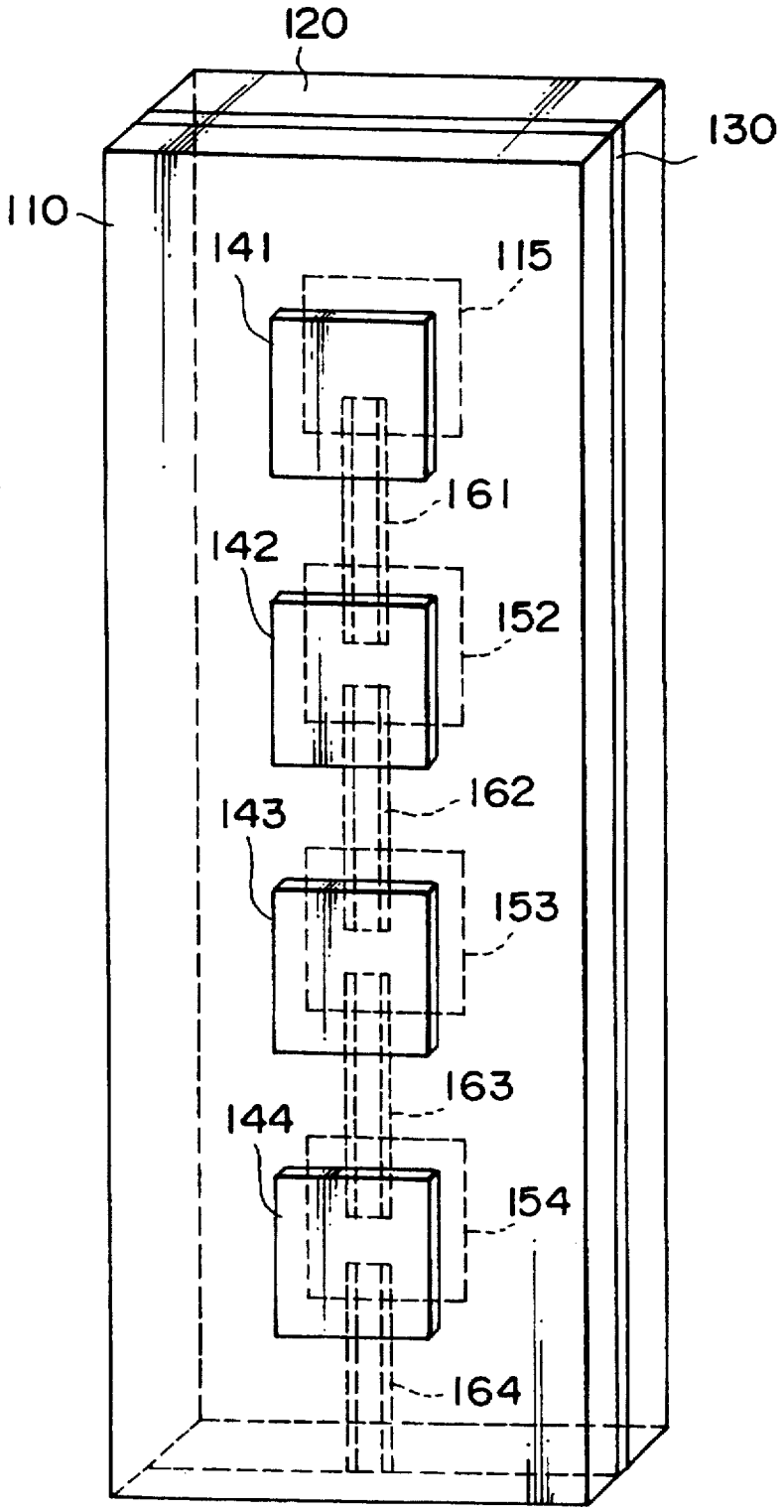
FIG. 6 is a perspective view showing an omnidirectional array antenna accordance with other embodiment of the present invention.

FIG. 6 is a perspective view showing an omnidirectional array antenna.

As shown in FIG. 6, in the omnidirectional array antenna, dielectric substrates 110, 120 and a ground conductor plate 130 are formed long. A plurality of antenna elements 141 to 144, 151 to 154 and a plurality of CPW feed lines 161 to 164 are arranged in the longer direction.

The CPW feed lines 161 to 164 are formed spanning respective adjacent antenna elements 141 to 144 and 151 to 154. In this case, selecting the length of the CPW feed lines 161 to 164 appropriately, the feed phase is shifted to tilt a beam having the radiation directivity.

According to the above-mentioned embodiment, the CPW feed line is used. In addition, it is possible to use other feed means.

Figure 7:
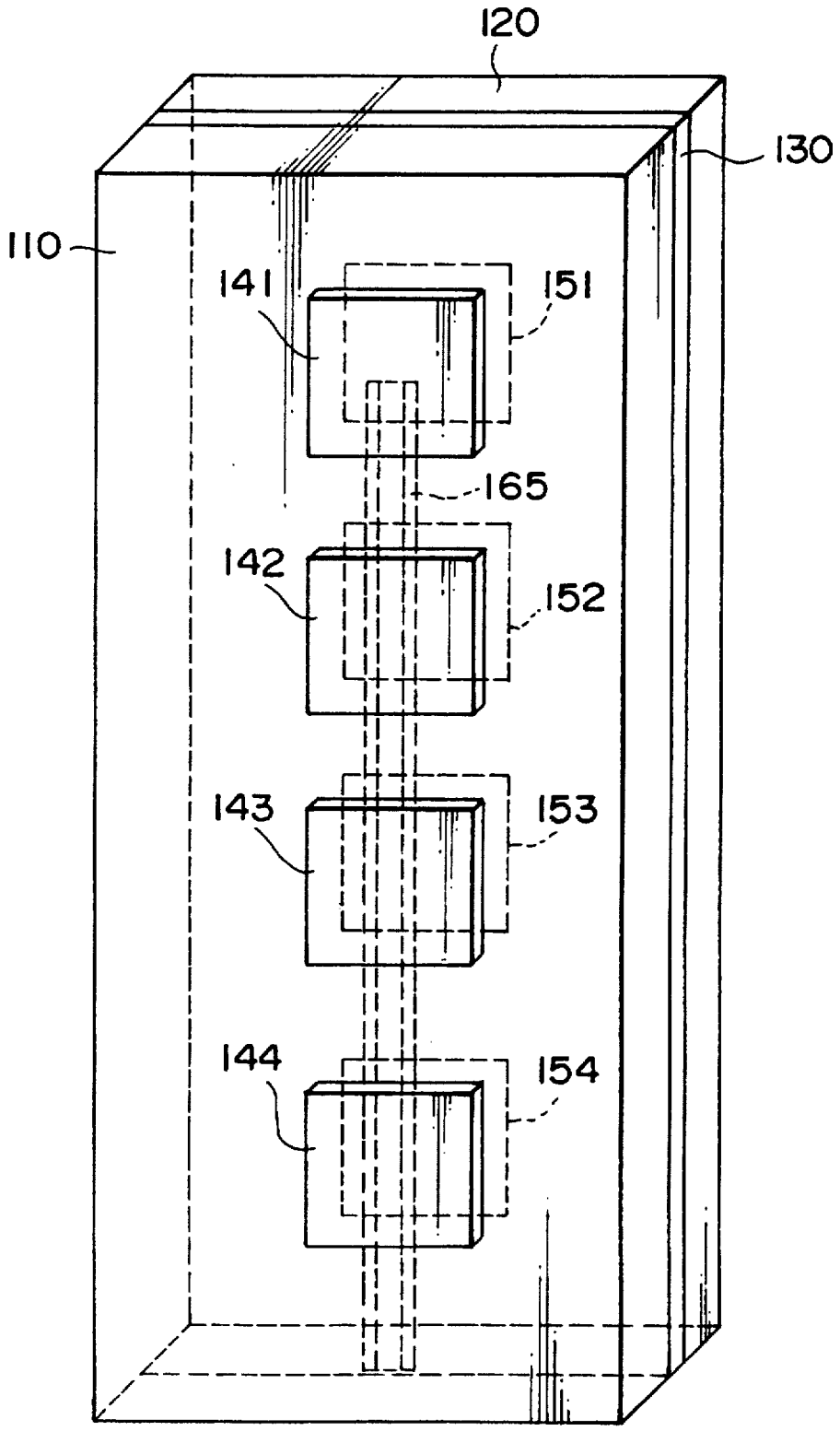
FIG. 7 is a perspective view showing the omnidirectional array antenna accordance with other embodiment of the present invention.

For example, it is possible to use a feed line 165 instead of the CPW feed lines in the omnidirectional array antenna as shown in FIG. 7.

Figure 8:
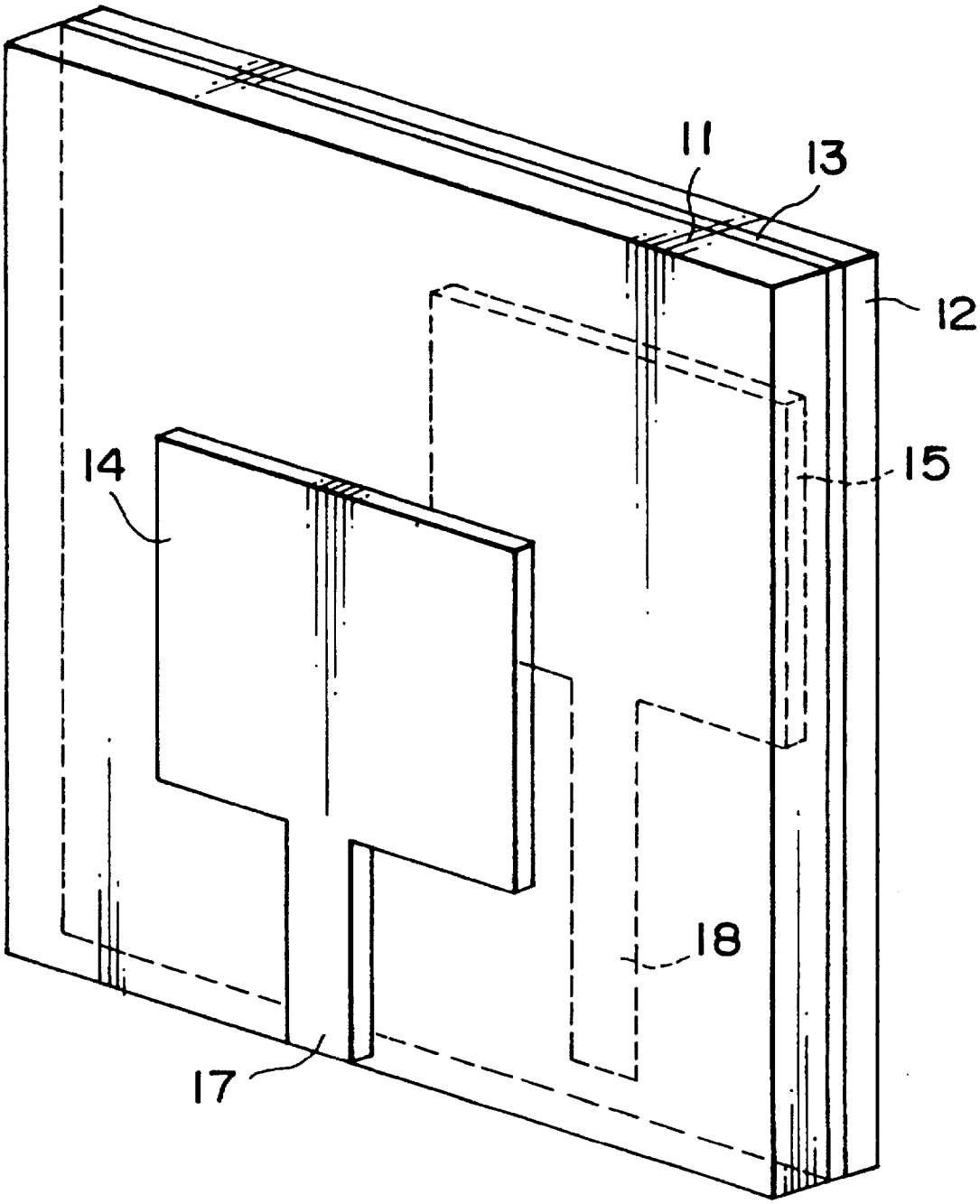
FIG. 8 is a perspective view showing the omnidirectional antenna accordance with other embodiment of the present invention.

FIG. 8 is a perspective view showing an omnidirectional array antenna according to the present invention using a direct feed line as a feed means.

As shown in FIG. 8, a first direct feed line 17 is formed on a first dielectric substrate 11 and is connected to a first antenna element 14. A second direct feed line 18 is formed on a second dielectric substrate 12 and is connected to a second antenna element 15.

Figure 9:
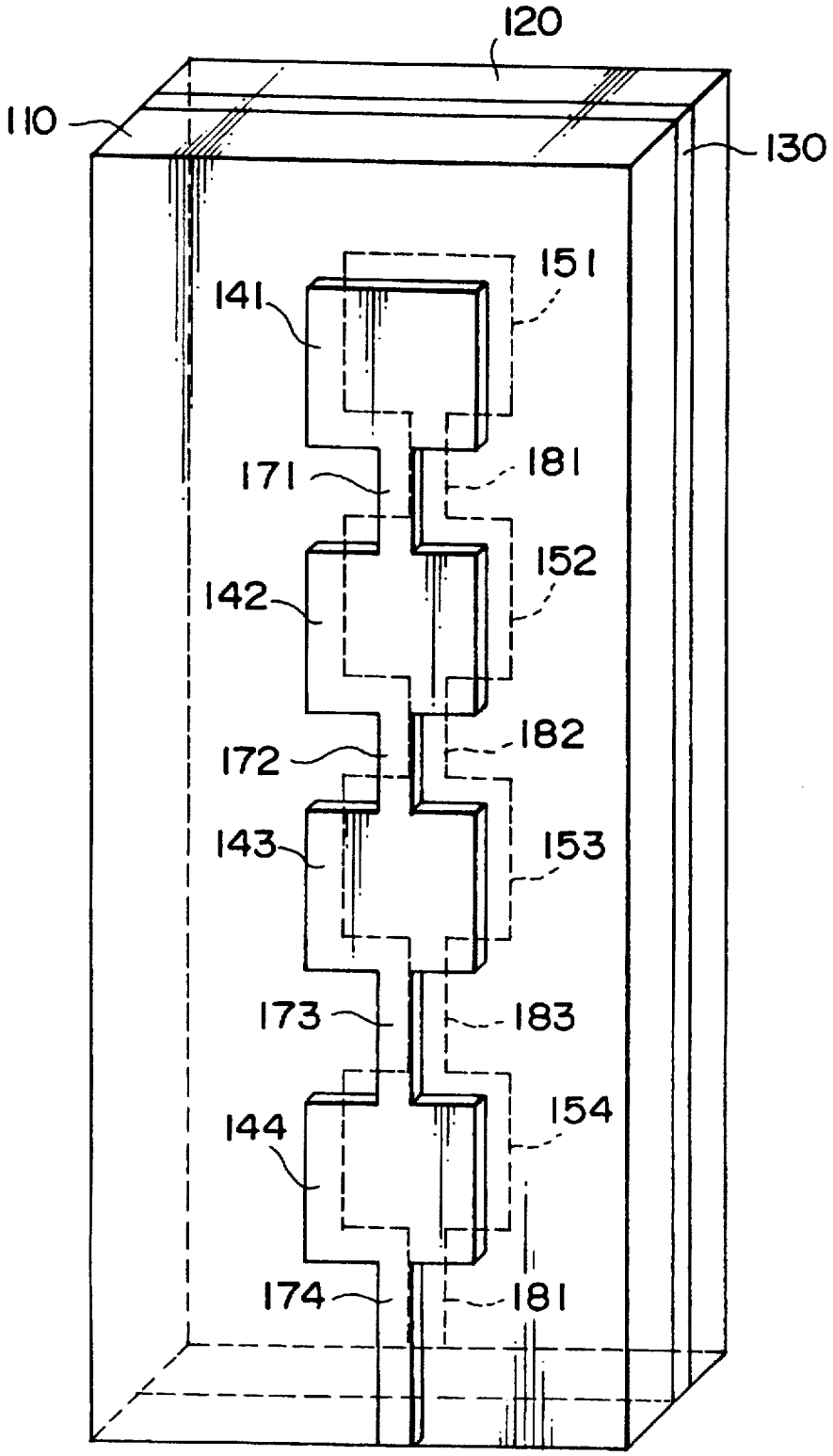
FIG. 9 is a perspective view showing the omnidirectional array antenna accordance with other embodiment of the present invention.

FIG. 9 is a perspective view showing an omnidirectional array antenna using a plurality of antennas in FIG. 8.

In the omnidirectional array antenna in FIG. 9, first direct feed lines 171 to 174 connect directly between respective adjacent first antenna elements 141 and 142, 142 and 143, 143 and 144, and second direct feed lines 181 to 184 connect directly between respective adjacent second antenna elements 151 and 152, 152 and 153, 153 and 154.

Figure 10:
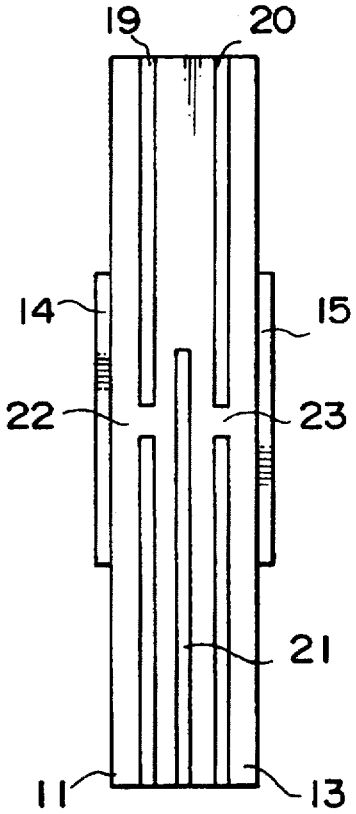
FIG. 10 is a perspective view showing the omnidirectional antenna accordance with other embodiment of the present invention.
Figure 11:
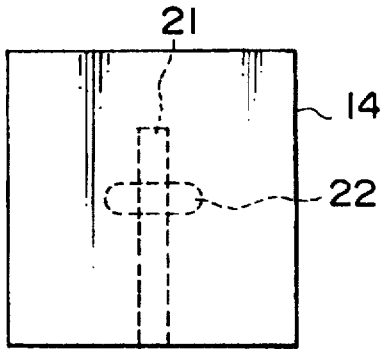
FIG. 11 is a partial front view of the omnidirectional antenna show in FIG. 10.

FIG. 10 is a sectional view showing an omnidirectional array antenna according to the present invention using a slot feed as a feed means. FIG. 11 is a partial front view of the array antenna in FIG. 10.

The omnidirectional antenna shown in FIGS. 10 and 11 has first ground conductor plate 19 and second ground conductor plate 20 faced each other, a feed line 21 as feed means formed between the first ground conductor plate 19 and the second ground conductor plate 20, and slot portions 22, 23 formed in the ground conductor plate 19 and the ground conductor plate 20, respectively.

Figure 12:
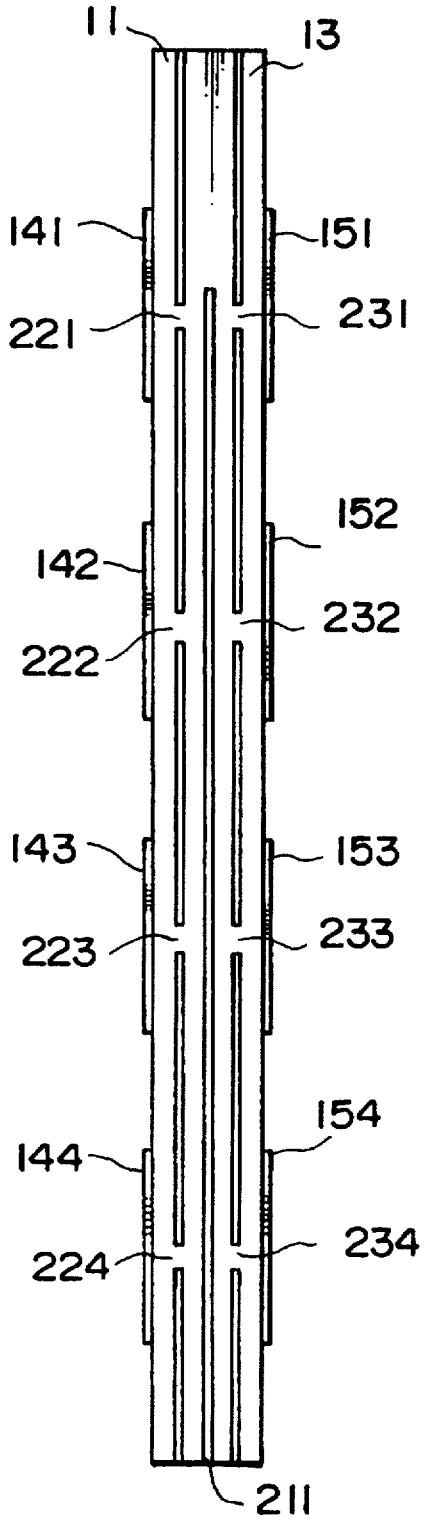
FIG. 12 is a perspective view showing the omnidirectional array antenna accordance with other embodiment of the present invention.

FIG. 12 is a sectional view showing an omnidirectional array antenna using a plurality of antennas shown in FIGS. 10 and 11.

In the omnidirectional array antenna shown in FIG. 12, a feed line 211 feeds first and second antenna elements 141 to 144 and 151 to 154 via respective slot portions 221 to 224 and 231 to 234.

Figure 13:
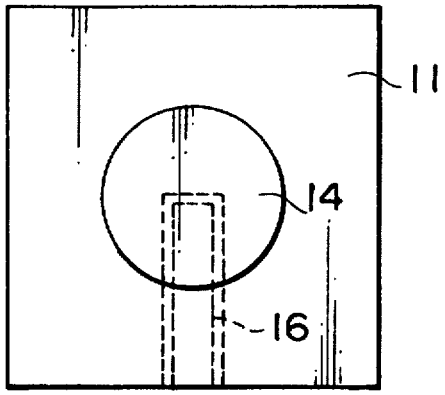
FIG. 13 shows other shape of an antenna element.
Figure 14:
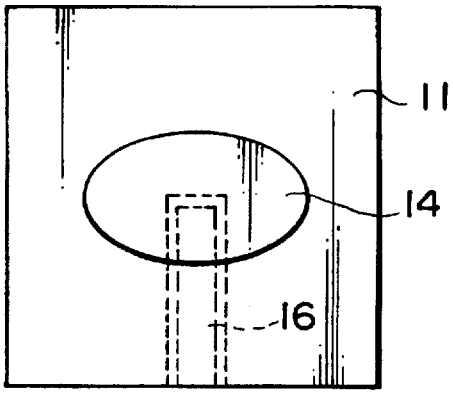
FIG. 14 shows other shape of the antenna element.
Figure 15:
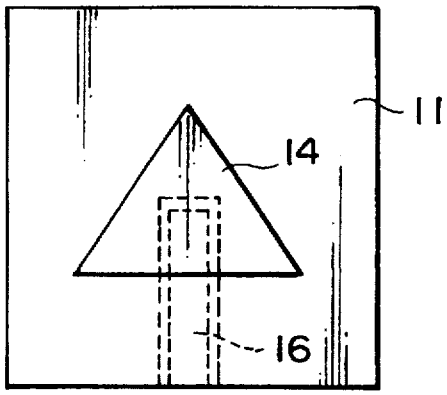
FIG. 15 shows other shape of the antenna element.

According to the above-mentioned embodiment, a form of the antenna element is rectangular. Also it is to be understood that a form of the antenna element employed herein is not limited thereto and may be changed. The form of the antenna element may be, for example, circle shown in FIG. 13, ellipse shown in FIG. 14, triangle shown in FIG. 15, or other shapes.

In addition, according to the present embodiment, the feed line is connected to the center of the antenna element. Positioning is not limited thereto and may be voluntary.

Figure 16:
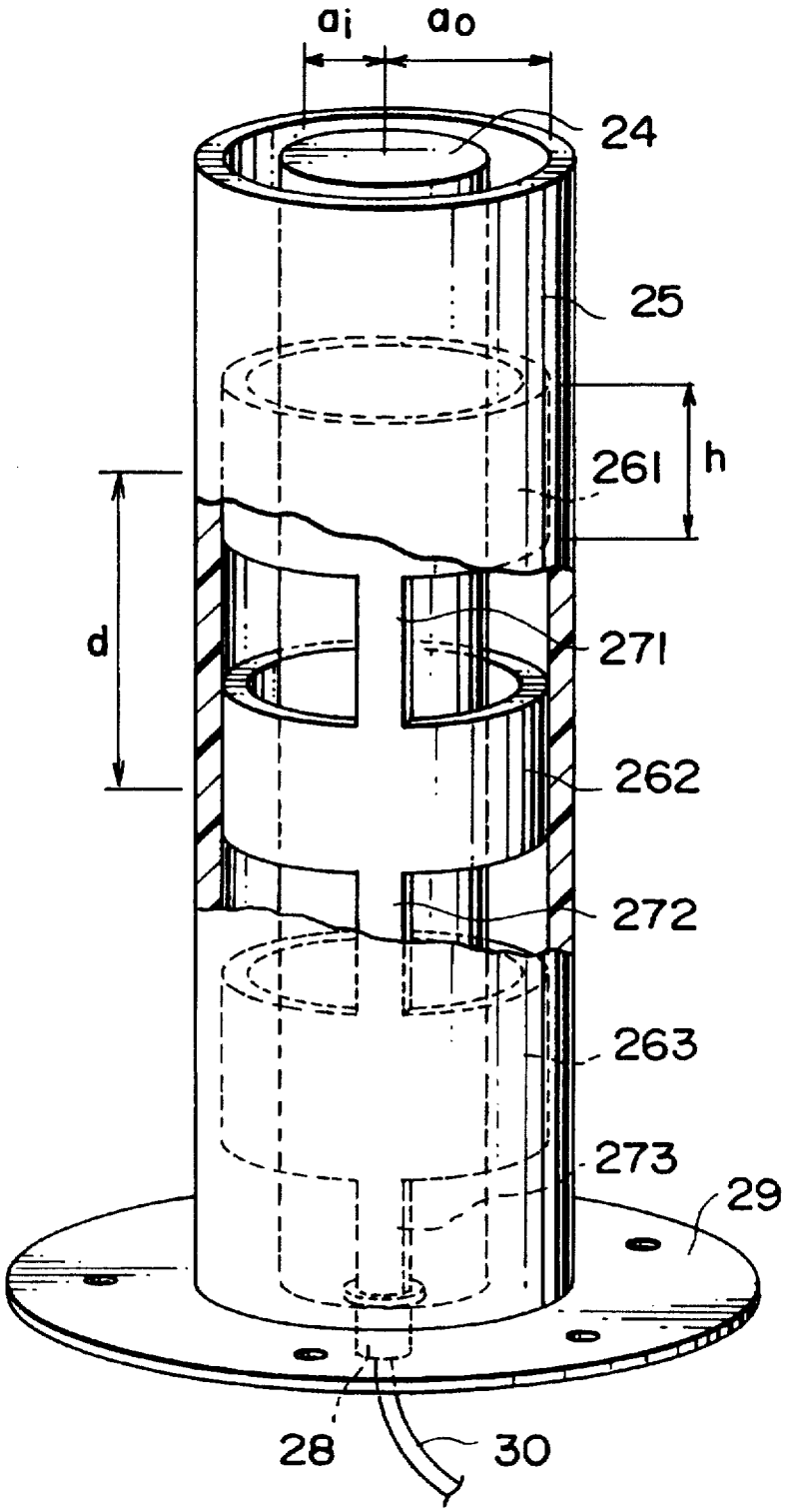
FIG. 16 is a perspective view of a construction of the omnidirectional array antenna accordance with another embodiment of the present invention.

FIG. 16 is a perspective view of a construction of the omnidirectional array antenna accordance with another embodiment of the present invention.

As shown in FIG. 16, a cylindrical dielectric substrate 25 is disposed surrounding a cylindrical ground conductor 24 made of a metal conductor. On the surface of the dielectric substrate 25 opposed to the ground conductor 24, a plurality of cylindrical antenna elements 261 to 263 made of a conductor film of a cooper leaf or the like are arranged at predetermined intervals in the longer direction of the dielectric substrate 25. The ground conductor 24 may be fistulous.

Microstrip feed lines 271 to 273 are formed between antenna elements 261 and 262, 262 and 263, and are also formed at the bottom of the antenna element 263. The antenna elements 261 to 263 and the microstrip feed lines 271 to 273 are formed by a photolithography technology.

An input/output terminal 28 is connected to the bottom edge portion of the microstrip feed line 273. A jig 29 is connected to the bottom edge portions of the ground conductor 24 and the dielectric substrate 25 to secure them and to install on the ceiling, or the like.

Preceding explaining the action of the omnidirectional antenna of the present embodiment, a normal microstrip antenna will be described shown in FIG. 17. The microstrip antenna is a rectangular patch antenna that configures a rectangular radiation conductor 201 having a width of a and a length of b on a first surface of a dielectric substrate 200, and configures a ground conductor plate 202 incorporated on a second surface of the dielectric substrate 200. The radiation conductor 201 is fed by a microstrip feed line 203 having an input/output terminal 204. A resonance frequency is dependent upon the length a of the radiation conductor 201. In general, an equation of $a=\lambda/2(\epsilon r)^{1/2}$ holds, where $\epsilon r$ is the specific inductive capacity of the dielectric substrate 200. On the other hand, an antenna input impedance is dependent upon the width b of the radiation conductor 201. The shorter b is, the lower the band width is. This rectangular patch antenna can be transformed to a cylindrical form. In this configuration, an omnidirectional antenna is realized as described in Japanese Patent Laid-open application Ser. No. HEI 6-224619 "MICROSTRIP ANTENNA." In addition to a feed method of direct feeding to the radiation conductor, other feed method by an electromagnetic coupling feeding, such as an aperture coupling feeding via a slot, an adjacent coupling feeding, a coupling feeding via the CPW feed line or the like.

Figure 17:
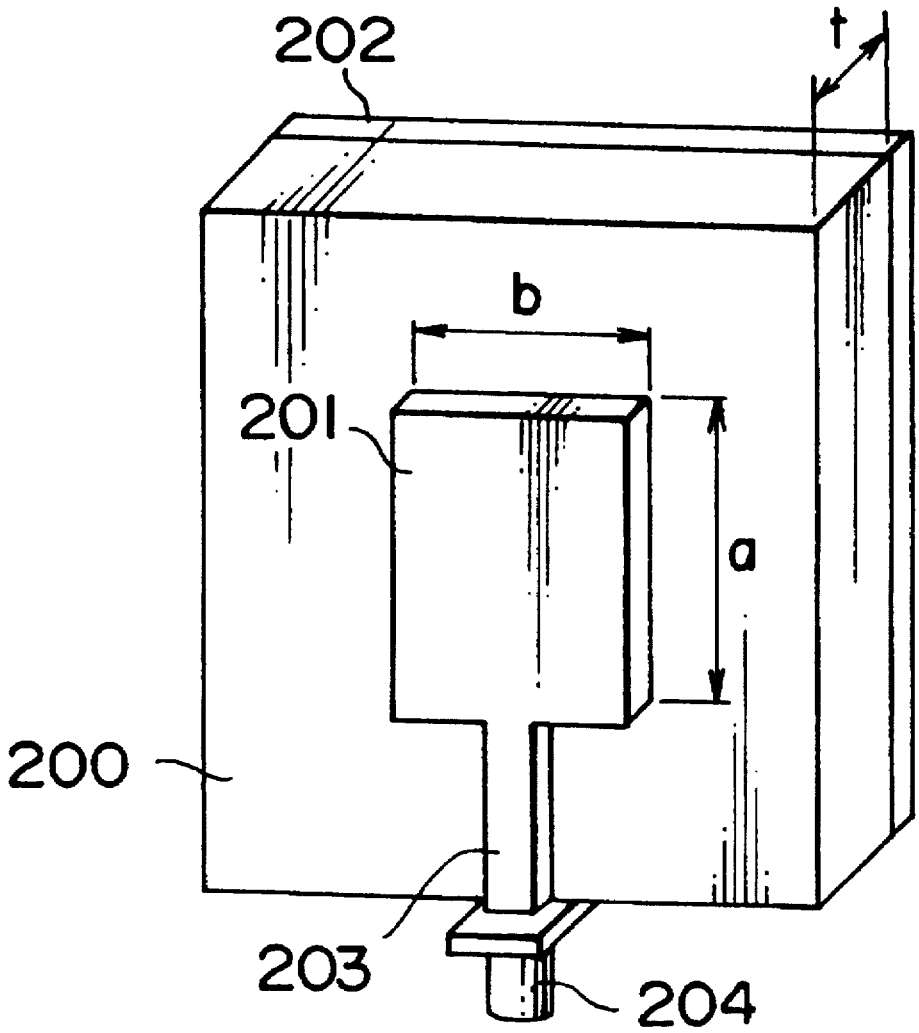
FIG. 17 is a perspective view showing a construction of a normal microstrip antenna.

On the other hand, in the antenna of the present embodiment shown in FIG. 16, the cylindrical ground conductor 24 having a radius of ai is equivalent to the ground conductor substrate 202 in FIG. 17, and a space (air layer) between the ground conductor 24 and the dielectric substrate 25 is equivalent to the dielectric substrate 200 in FIG. 17. Outer surface of the dielectric substrate 25 can be used as a radome. In other words, the dielectric substrate 25 retains antenna elements, as well as protects an inner structure like antenna elements from the outer environment. In addition, a difference between a radius ao of antenna elements 261 to 263 and a radius ai of the ground conductor 24 is equivalent to a thickness t of the dielectric substrate 200 in FIG. 17. The t is decided in consideration of the band width. Moreover, a height h of antenna elements is equivalent to a length a of the radiation conductor 201 in FIG. 17. The h is set using an equation, $h=\lambda/2(\epsilon r)^{1/2}$. According to the present embodiment, $\epsilon r=1.0$, for example.

The antenna elements 261 to 263 are arranged at intervals of d and are fed by the microstrip feed lines 271 to 273. When feeding, the microstrip feed lines 271 to 273 are matched with the input impedances of the antenna elements 261 to 263 and the width h is decided so that the antenna elements 261 to 263 realize a predetermined exciting distribution. In addition, adjusting the lengths of the microstrip feed lines 271 to 273, the feed phase is shifted to tilt a beam within a horizontal surface at appropriate angle.

More over, the antenna can be used as a base station antenna for mobile radio or mobile communication use by connecting a cable 30 to the input/output terminal 28. In this case, whole antenna can be easily installed on the ceiling or the like using the jig 29.

Thus, the present embodiment in FIG. 16 has advantages of having a mechanical strength and an excellent environmental resistance.

Figure 18A:
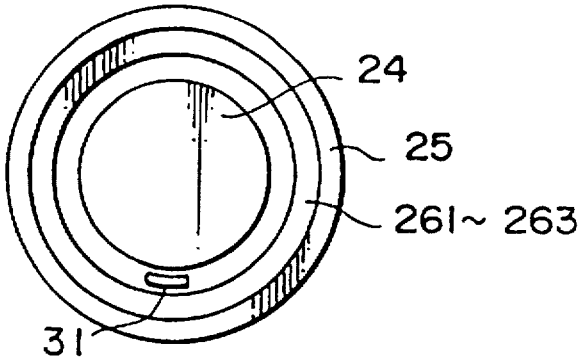
FIG. 18 is a perspective view showing a construction of the omnidirectional array antenna accordance with another embodiment of the present invention.
Figure 18B:
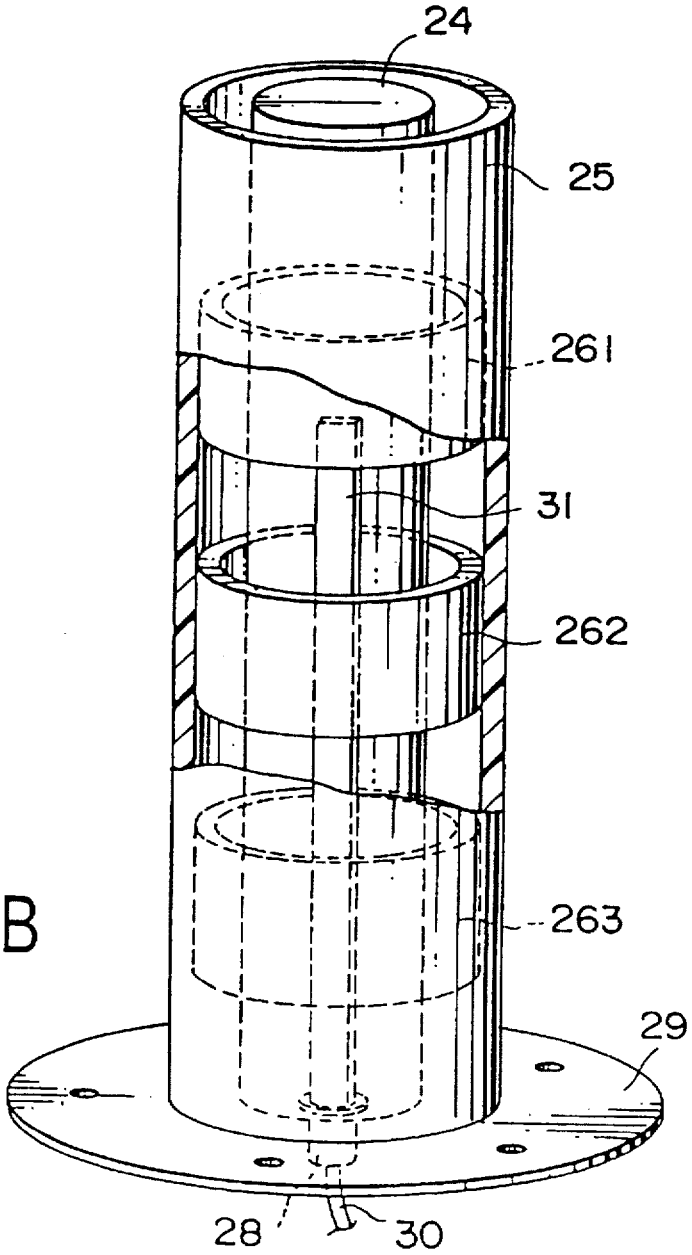

FIG. 18 shows another embodiment. In the embodiment in FIG. 16, the antenna elements 261 to 263 are fed directly by the microstrip feed lines 271 to 273. On the other hand, in the embodiment in FIG. 18, the antenna elements 261 to 263 are fed by an adjacent coupling feeding which is an electromagnetic coupling feeding, disposing a feed line 31 between the ground conductor 24 and the antenna elements 261 to 263. Advantages of the present embodiment are identical to the embodiment in FIG. 16.

Figure 19:
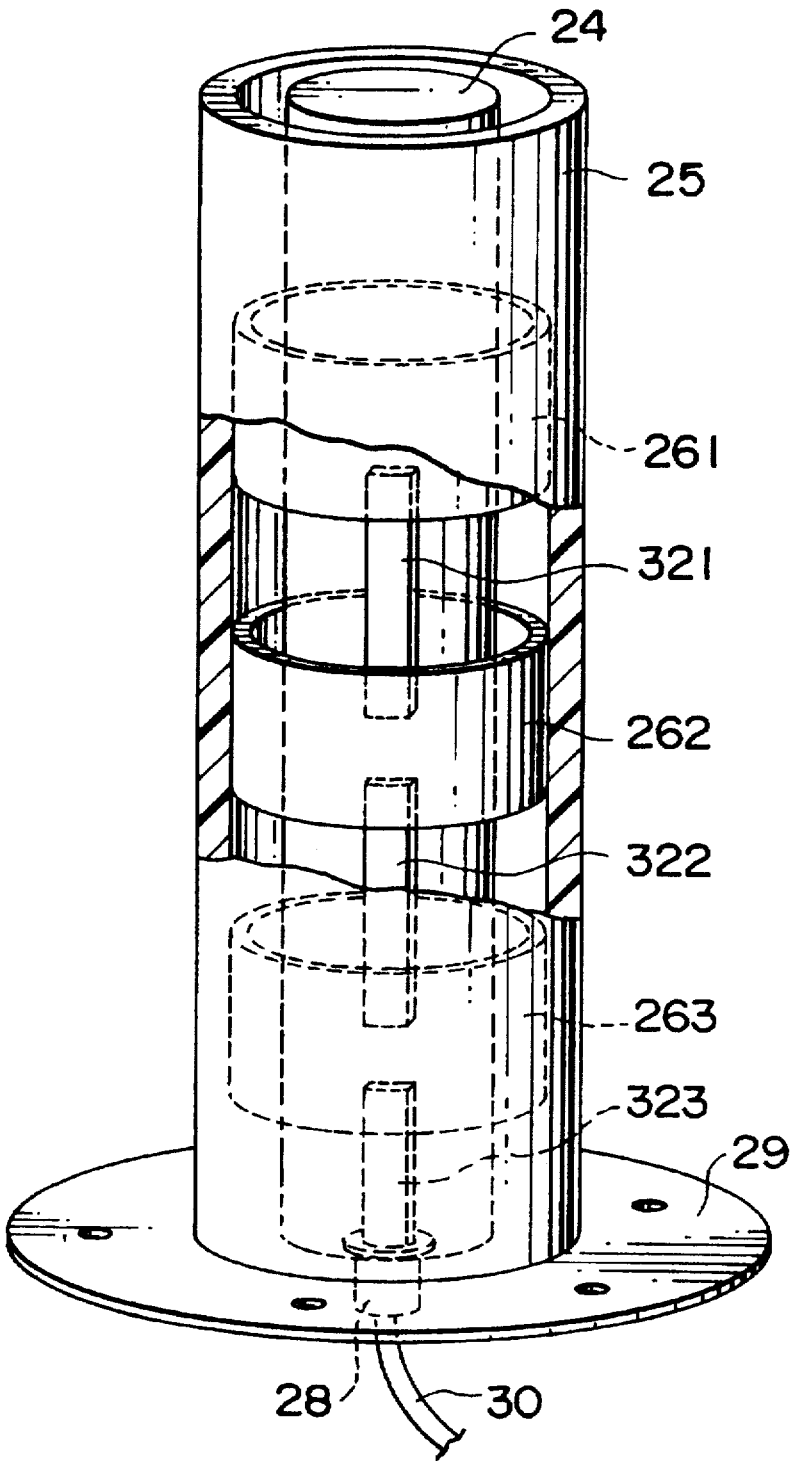
FIG. 19 is a perspective view showing a construction of the omnidirectional array antenna accordance with another embodiment of the present invention.

FIG. 19 is other embodiment of the present invention. Instead of a continuous feed line 31 in FIG. 18, feed lines 321 to 323 connecting between antenna elements 261 and 262, 262 and 263 are used. Advantages of the present embodiment are identical to the embodiments in FIGS. 16 and 18.

In the embodiments shown in FIGS. 16, 18 and 19, a lightweight antenna can be realized to be fistulous within the column 24.

Figure 20A:
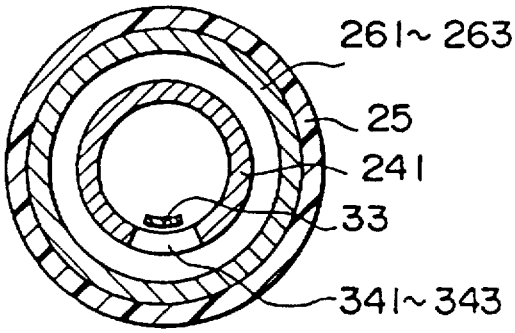
FIG. 20 is a perspective view showing a construction of the omnidirectional array antenna accordance with another embodiment of the present invention.
Figure 20B:
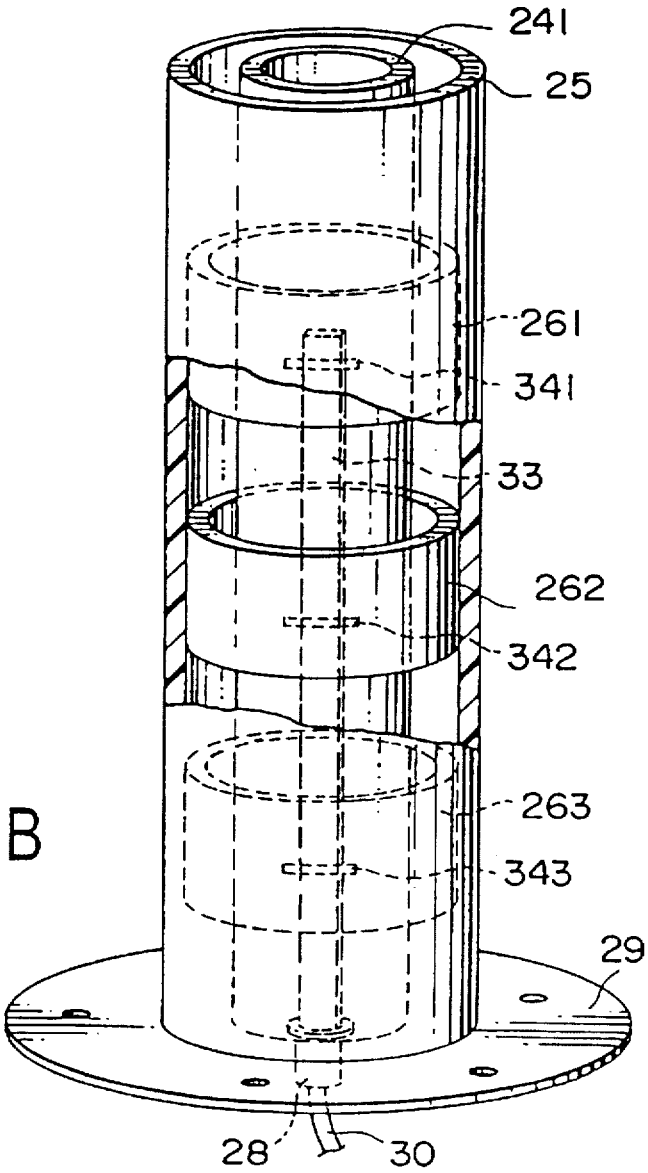
Figure 21:
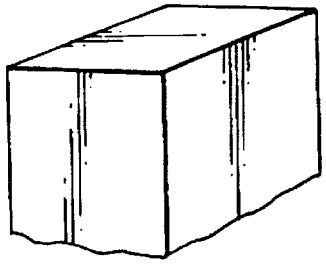
FIG. 21 shows other shape of the ground conductor.
Figure 22:
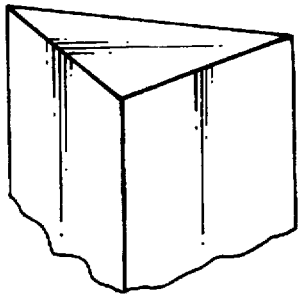
FIG. 22 shows other shape of the ground conductor.
Figure 23:
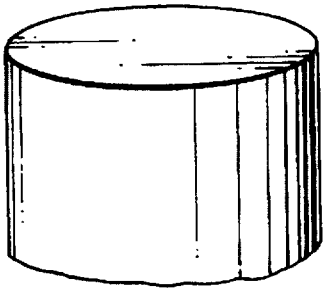
FIG. 23 shows other shape of the ground conductor.
Figure 24:
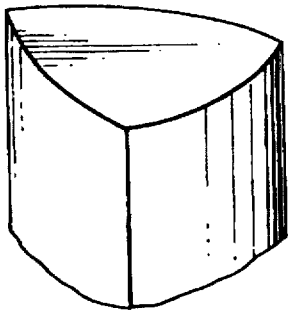
FIG. 24 shows other shape of the ground conductor.
Figure 25:
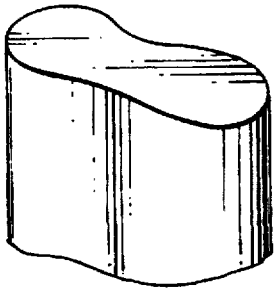
FIG. 25 shows other shape of the ground conductor.

FIG. 20 shows another embodiment of the present invention. In this embodiment, a microstrip feed line 33 is formed within a fistulous ground conductor 241 along with a long side of the ground conductor 241 and antenna elements 261 to 263 are fed via slots 341 to 343 formed faced with the antenna elements 261 to 263 of the ground conductor 241.

According to the present embodiment, the microstrip feed line 33 is formed within the ground conductor 241. Therefore, an excessive radiation from the feed line 33 to the outside is more effectively suppressed. In addition, the microstrip feed line 33 is formed within the ground conductor 241, thereby increasing free degree of the feed line 33 arrangement. Thus, optimum amplitude and phase distribution are easily obtained. Moreover, an active micro wave element like an amplifier can be built-in the fistulous ground conductor 241, thereby a small antenna is obtained.

In FIGS. 16 to 20, the ground conductor 24 is column. Also it is to be understood that a form of the ground conductor employed herein is not limited thereto and may be in any shape of pillar, for example, a quadrangular prism, a trigonal prism, an elliptic cylinder or the like as shown in FIGS. 21 to 25.

In addition, in FIG. 16, there is a space, in other words, an air layer whose specific inductive capacity is 1 between the ground conductor 24 and the antenna elements 261 to 263. Also it is to be understood that a dielectric material having the specific inductive capacity 1 or more may be inserted into between the ground conductor 24 and the antenna elements 261 to 263.

Moreover, in FIGS. 16 to 20, the array antenna is explained as an example. Also it is to be understood that the present invention is applied for an antenna having just one antenna element instead of an array antenna.

As described above, according to the present invention, an omnidirectional antenna is provided that has such radiation directivity as omnidirectional to a horizontal surface, and as beam-tilted downward to a vertical surface. In this case, antenna elements are formed on a dielectric substrate as a patch antenna using a photolithography technology or the like. Therefore, a unit cost of elements is low, as well as a plurality of antenna elements are arranged on common first and second dielectric substrates to realize an array antenna. Thus, a small array antenna is obtained with a simple production method at a lower cost. In addition, feed lines are formed within the ground conductor plate between first and second dielectric substrates. Therefore, no excessive radiation is occurred from the feed line to the outside of the antenna. Consequently, it shows an excellent antenna gain.

Further according to the present invention, an omnidirectional antenna is provided that has such radiation directivity as omnidirectional to a horizontal surface, and as beam-tilted downward to a vertical surface by forming a pillar shape of a ground conductor, and cylindrical antenna elements on a surface faced with a cylindrical shape of dielectric substrate surrounding the ground conductor. In this case, cylindrical antenna elements are formed on the dielectric substrate as a patch antenna using a photolithography technology or the like. Therefore, a unit cost of elements is low, as well as a plurality of antenna elements are arranged on the dielectric substrate to realize an array antenna. Thus, a small array antenna is obtained with a simple production method at a lower cost. In addition, microstrip feed lines are formed within the cylindrical dielectric substrate. Therefore, no excessive radiation is occurred from the feed lines to the outside of the antenna. Consequently, it shows an excellent antenna gain. Moreover, all conductor portions of the antenna elements and the feed lines are formed within the cylindrical dielectric substrate, which are used as a radome. Thus, an environmental resistance is enhanced without installing a radome separately.

What is claimed is:

1. An antenna, comprising:

a ground conductor plate;

a first antenna element opposed to a first surface of said ground conductor plate;

a second antenna element opposed to a second surface of said ground conductor plate; and a feed line time electromagnetically coupling and feeding both said first antenna element and said second antenna element.

2. The antenna as set forth in claim 1, said antenna further comprising:

a first dielectric substrate formed between said ground conductor plate and said first antenna element; and a second dielectric substrate formed between said ground conductor plate and said second antenna element.

3. The antenna as set forth in claim 1, wherein said feed line is a coplanar waveguide feed line.

4. The antenna as set forth in claim 1, wherein said feed line feeds said first antenna element and said second antenna element via a slot feed.

5. The antenna as set forth in claim 4, wherein said ground conductor plate has a first ground conductor plate and a second ground conductor plate facing each other; and said feed line is formed between said first ground conductor plate and said second ground conductor plate, and slot portions disposed on said first ground conductor plate and on said second ground conductor plate, respectively.

6. The antenna as set forth in claim 2, wherein said first antenna element is a first patch antenna formed on a first dielectric substrate; and said second antenna element is a second patch antenna formed on a second dielectric substrate.

7. The antenna as set forth in claim 2, wherein dimensions of said first dielectric substrate and said second dielectric substrate which intersect with longer sides said feed line at right angle are set to 0.1 to 0.35 times of wave length used.

8. The antenna as set forth in claim 1, wherein a plurality of said first antenna elements and a plurality of said second antenna elements are formed at predetermined intervals along with longer sides of said feed line.

9. The antenna as set forth in claim 8, wherein a plurality of said first antenna elements and a plurality of said second antenna elements are fed by an electromagnetic coupling feeding via one continuous coplanar waveguide feed line.

10. The antenna as set forth in claim 8, wherein adjacent antenna elements of said plurality of first antenna elements and adjacent antenna elements of said plurality of second antenna elements are fed by an electromagnetic coupling feeding via independent coplanar waveguide feed lines.

11. The antenna as set forth in claim 8, wherein said ground conductor plate has a first ground conductor plate and a second ground conductor faced each other; and a plurality of said first antenna elements and a plurality of said second antenna elements are fed by an electromagnetic coupling feeding via one continuous feed line disposed between said first ground conductor plate and said second ground conductor plate, and via slot portions disposed on said first ground conductor plate and said second ground conductor plate.

12. An antenna comprising:

a pillar-shaped ground conductor;

a cylindrical dielectric substrate formed surrounding said ground conductor;

a plurality of cylindrical antenna element formed on an inside surface of said dielectric substrate; and a feed means for feeding said antenna element;

wherein a plurality of said antenna elements are fed by an electromagnetic coupling feeding via one continuous feed line of the feed means.

13. An antenna comprising:

a pillar-shaped ground conductor;

a cylindrical dielectric substrate formed surrounding said ground conductor;

a plurality of cylindrical antenna element formed on an inside surface of said dielectric substrate; and a feed means for feeding said antenna elements;

wherein adjacent antenna elements of a plurality of said antenna elements are fed by an electromagnetic coupling feeding via independent coplanar feed lines of the feed means.

14. An antenna comprising:

a pillar-shaped ground conductor;

a cylindrical dielectric substrate formed surrounding said ground conductor;

a plurality of cylindrical antenna element formed on an inside surface of said dielectric substrate; and a feed means for feeding said antenna elements;

659 wherein said ground conductor is tube-shaped; and a plurality of said antenna elements are fed by an electromagnetic coupling feeding via one feed line of the feed means disposed within said ground conductor and via slot portions disposed on said ground conductor.

15. An antenna, comprising:

a ground conductor plate;

a plurality of first antenna elements opposed to a first surface of said ground conductor plate;

a plurality of second antenna elements opposed to a second surface of said ground conductor plate; and a feed means for feeding said first antenna elements and said second antenna elements, wherein said first antenna elements and said second antenna elements are formed at predetermined intervals along longer sides of said feed means so that the antenna has radiation directivity beam-tilted to a predetermined vertical direction.

* * * * *

UNITED STATES PATENT AND TRADEMARK OFFICE

CERTIFICATE OF CORRECTION

PATENT NO.: 5,898,405

DATED: April 27, 1999

INVENTOR(S): Iwasaki

It is certified that an error appears in the above-identified patent and that said Letters Patent is hereby corrected as shown below:

*Claim 1, column 9, line 44, delete "time".

Claim 12, column 10, line 44, "element" should read --elements--; and
line 46, "element" should read --elements--.

Claim 13, column 10, line 54, "element" should read --elements--.

Claim 14, column 10, line 66, "element" should read --elements--; and
column 11, line 2, delete "659".

*Claim 15, column 12, line 6, insert "vertical" before "intervals".

Signed and Sealed this
Twenty-fifth Day of January, 2000

*Attest:*

*Attesting Officer*

*Acting Commissioner of Patents and Trademarks*